US010154357B2

(12) United States Patent
Gran et al.

(10) Patent No.: US 10,154,357 B2
(45) **Date of Patent: *Dec. 11, 2018**

(54) PERFORMANCE BASED IN SITU OPTIMIZATION OF HEARING AIDS

(71) Applicant: GN HEARING A/S, Ballerup (DK)

(72) Inventors: Karl-Fredrik Johan Gran, Malmo (SE); Aalbert De Vries, Eindhoven (NL)

(73) Assignee: GN HEARING A/S, BALLERUP (DK)

( * ) Notice: Subject to any disclaimer, the term of this patent is extended or adjusted under 35 U.S.C. 154(b) by 0 days.

This patent is subject to a terminal disclaimer.

(21) Appl. No.: 15/630,366

(22) Filed: Jun. 22, 2017

(65) Prior Publication Data

US 2017/0295440 A1 Oct. 12, 2017

Related U.S. Application Data

(63) Continuation of application No. 15/346,249, filed on Nov. 8, 2016, now Pat. No. 9,838,805, which is a continuation of application No. 14/788,615, filed on Jun. 30, 2015, now Pat. No. 9,723,415.

(30) Foreign Application Priority Data

Jun. 19, 2015 (DK) ..... 2015 70379
Jun. 19, 2015 (EP) ..... 15172898

(51) Int. Cl.
*H04R 25/00* (2006.01)

(52) U.S. Cl.
CPC ..... *H04R 25/558* (2013.01); *H04R 25/407* (2013.01); *H04R 25/505* (2013.01); *H04R 25/552* (2013.01); *H04R 25/70* (2013.01); *H04R 25/507* (2013.01); *H04R 2225/021* (2013.01); *H04R 2225/41* (2013.01); *H04R 2225/55* (2013.01); *H04R 2225/61* (2013.01); *H04R 2460/07* (2013.01); *H04R 2460/13* (2013.01)

(58) Field of Classification Search
CPC ..... H03G 5/165; H04R 25/70; H04R 25/558
USPC .... 375/233; 381/58, 60, 314, 315, 312, 313, 381/318, 323, 330, 331
See application file for complete search history.

(56) References Cited

U.S. PATENT DOCUMENTS 5,600,728 A 2/1997 Satre
6,078,675 A * 6/2000 Bowen-Nielsen ..... H04M 1/6058 381/331
6,658,122 B1 12/2003 Westermann
(Continued)

FOREIGN PATENT DOCUMENTS

EP 2 426 953 A1 3/2012
EP 2 528 357 A1 11/2012
(Continued)

OTHER PUBLICATIONS

Notice of Allowance and Fee(s) due dated Aug. 2, 2017 for related U.S. Appl. No. 15/346,249.
(Continued)

*Primary Examiner* — Gerald Gauthier
(74) *Attorney, Agent, or Firm* — Vista IP Law Group, LLP

(57) ABSTRACT

A new hearing aid system is provided that facilitates determination of listening performance of a user of the hearing aid system and adjustment of a hearing aid for improved listening performance.

18 Claims, 4 Drawing Sheets

(56) References Cited

U.S. PATENT DOCUMENTS

| | | | | |
|---|---|---|---|---|
| 7,016,504 | B1 | 3/2006 | Shennib | |
| 7,027,608 | B2 * | 4/2006 | Fretz | H04R 25/65 381/322 |
| 7,082,205 | B1 | 7/2006 | Westermann | |
| 7,288,072 | B2 | 10/2007 | Stott | |
| 7,433,481 | B2 * | 10/2008 | Armstrong | H04R 25/356 381/312 |
| 7,515,720 | B2 | 4/2009 | Schwob | |
| 8,238,565 | B2 | 8/2012 | Johannesson | |
| 8,433,071 | B2 | 4/2013 | Latzel | |
| 8,538,033 | B2 | 9/2013 | Wilson | |
| 9,319,019 | B2 * | 4/2016 | Selig | H03G 5/165 |
| 9,723,415 | B2 * | 8/2017 | Gran | H04R 25/70 |
| 9,838,805 | B2 * | 12/2017 | Gran | H04R 25/558 |
| 9,894,450 | B2 * | 2/2018 | Shennib | H04R 25/70 |
| 2003/0099370 | A1 | 5/2003 | Moore | |
| 2004/0234090 | A1 | 11/2004 | Berg | |
| 2005/0157895 | A1 | 7/2005 | Lichtblau | |
| 2005/0283263 | A1 | 12/2005 | Eaton | |
| 2007/0076909 | A1 | 4/2007 | Roeck | |
| 2007/0196796 | A1 | 8/2007 | Strother | |
| 2008/0240476 | A1 | 10/2008 | Latzel | |
| 2008/0260171 | A1 | 10/2008 | Nordahn | |
| 2008/0260190 | A1 | 10/2008 | Kidmose | |
| 2008/0292122 | A1 | 11/2008 | Nordahn | |
| 2008/0298615 | A1 | 12/2008 | Klinikby | |
| 2008/0317268 | A1 | 12/2008 | Nordahn | |
| 2009/0067654 | A1 | 3/2009 | Klinikby | |
| 2009/0097683 | A1 | 4/2009 | Burns | |
| 2009/0129619 | A1 | 5/2009 | Nordahn | |
| 2010/0076339 | A1 | 3/2010 | Marcoux | |
| 2010/0086143 | A1 | 4/2010 | Norgaard et al. | |
| 2010/0111315 | A1 | 5/2010 | Kroman | |
| 2010/0172523 | A1 | 7/2010 | Burns | |
| 2011/0237295 | A1 | 9/2011 | Bartkowiak | |
| 2012/0008807 | A1 | 1/2012 | Gran | |
| 2012/0070023 | A1 | 3/2012 | Nishizaki | |
| 2012/0177212 | A1 | 7/2012 | Hou | |
| 2012/0183164 | A1 | 7/2012 | Foo | |
| 2013/0034234 | A1 * | 2/2013 | Chen | H04M 1/72591 381/58 |
| 2013/0177189 | A1 * | 7/2013 | Bryant | H04R 25/55 381/315 |
| 2013/0202138 | A1 | 8/2013 | Nishizaki | |
| 2013/0226574 | A1 | 8/2013 | Krause et al. | |
| 2013/0243227 | A1 | 9/2013 | Kinsbergen et al. | |
| 2013/0322669 | A1 | 12/2013 | Boretzki | |
| 2014/0003641 | A1 * | 1/2014 | Neumeyer | H04R 25/30 381/323 |
| 2014/0023217 | A1 * | 1/2014 | Zhang | H04R 25/554 381/315 |
| 2014/0198935 | A1 | 7/2014 | Moesgaard | |
| 2014/0211972 | A1 | 7/2014 | Kim | |
| 2014/0334629 | A1 | 11/2014 | Andersen | |
| 2014/0355798 | A1 | 12/2014 | Sabin | |
| 2015/0003652 | A1 | 1/2015 | Bisgaard | |
| 2015/0010160 | A1 | 1/2015 | Udesen | |
| 2015/0023512 | A1 * | 1/2015 | Shennib | H04R 25/70 381/60 |
| 2015/0023535 | A1 * | 1/2015 | Shennib | H04R 25/70 381/314 |
| 2015/0163078 | A1 * | 6/2015 | An | H04L 27/36 375/233 |
| 2015/0181356 | A1 | 6/2015 | Krystek | |
| 2015/0189450 | A1 * | 7/2015 | Van Der Werf | H04R 25/453 381/318 |
| 2015/0256942 | A1 * | 9/2015 | Kinsbergen | H04R 25/70 381/313 |
| 2016/0198271 | A1 * | 7/2016 | Shennib | H04R 25/30 381/60 |
| 2016/0373869 | A1 * | 12/2016 | Gran | H04R 25/70 |
| 2017/0055087 | A1 | 2/2017 | Racca | |
| 2017/0055090 | A1 * | 2/2017 | Gran | H04R 25/70 |
| 2017/0094420 | A1 | 3/2017 | Boldt | |
| 2017/0295440 | A1 * | 10/2017 | Gran | H04R 25/558 |

FOREIGN PATENT DOCUMENTS

| | | | |
|---|---|---|---|
| EP | 2 549 397 | A1 | 1/2013 |
| EP | 2 736 273 | A1 | 5/2014 |
| EP | 2 813 175 | A2 | 12/2014 |
| EP | 2 813 175 | A3 | 4/2015 |
| EP | 2 871 858 | A1 | 5/2015 |
| EP | 2 884 766 | A1 | 6/2015 |
| WO | WO 2012/066149 | A1 | 5/2012 |

OTHER PUBLICATIONS

First Art. 94(3) Communication dated Sep. 14, 2017 for related European Application No. 15172898.7.

First Technical Examination dated Sep. 11, 2015, for related Danish Patent Application No. PA 2015 703797, 5 pages.

Extended European Search Report dated Nov. 3, 2015, for related European Patent Application No. 15172898.7, 11 pages.

Non-final Office Action dated Jul. 8, 2016 for related U.S. Appl. No. 14/788,615.

Notice of Allowance and Fee(s) due dated Nov. 21, 2016 for related U.S. Appl. No. 14/788,615.

Non-final Office Action dated Feb. 24, 2017 for related U.S. Appl. No. 15/346,249.

Notice of Allowance and Fee(s) due dated Mar. 28, 2017 for related U.S. Appl. No. 14/788,615.

Summons to attend oral proceedings dated Apr. 30, 2018 for related European Application No. 15172898.7.

* cited by examiner

PERFORMANCE BASED IN SITU OPTIMIZATION OF HEARING AIDS

RELATED APPLICATION DATA

This application is a continuation of U.S. patent application Ser. No. 15/346,249, filed Nov. 8, 2016, pending, which is a continuation of U.S. patent application Ser. No. 14/788,615, filed on Jun. 30, 2015, pending, which claims priority to and the benefit of Danish Patent Application No. PA 2015 70379 filed Jun. 19, 2015, pending, and European Patent Application No. 15172898.7 filed Jun. 19, 2015, pending. The entire disclosures of all of the above applications are expressly incorporated by reference herein.

FIELD

A new hearing aid system is provided that facilitates determination of listening performance of a user of the hearing aid system and adjustment of a hearing aid for improved listening performance. The adjustment may be based on determined listening performance of users of other hearing aid systems.

BACKGROUND

Today's hearing aids are usually provided with a signal processor and a number of different signal processing algorithms, wherein each algorithm is tailored to particular user preferences and particular categories of sound environment. Signal processing parameters of the various signal processing algorithms are typically determined during an initial fitting session in a dispenser's office and programmed into the hearing aid by activating desired algorithms and setting algorithm parameters in a non-volatile memory area of the hearing aid and/or transmitting desired algorithms and algorithm parameter settings to the non-volatile memory area.

Typically, an audiologist spends a very limited amount of time on fitting a hearing aid to each patient compared to all the nuances that are associated with hearing loss. Diagnostic procedures exist which would optimize the prescribed hearing aid parameters to maximize the benefit that the patient would get out of their hearing instruments. Unfortunately, the time needed to carry out these procedures is prohibitive for the audiologist and instead they often resort to an automatic fitting procedure with minimal personalization. This results in several return visits to the audiologist for the patient, alternatively that the patient gives up and deems the hearing instrument as being more of a burden than a benefit and the instrument ends up not being used.

Another fundamental challenge is that the fitting procedure is based on a parametric model defined by the hearing aid manufacturer. This model can be based on e.g. loudness perception, cochlear compression modelling and/or audibility threshold shifts. This implies that the solution space and the possible hearing aid configurations are limited to what the designing scientists think they know about hearing loss, or essentially how good the hearing loss model is in predicting listening performance of the individual patient.

It is known from several studies that the hearing loss model that is typically used is fundamentally wrong. For instance, if the hearing aid is fitted to compensate exactly for the modelled loss of compression in the cochlea, the sound will be uncomfortably loud, which indicates that the model is flawed. Another example of where the model breaks down is when trying to fit hearing impaired subjects with similar or close to identical audiograms but different levels of cognition; here, the higher performing subjects benefit from syllabic compression whereas the lower performing patients benefit more from longer time constants in the compression. The challenge is that the optimization of the hearing aid is based on adjusting a model that is believed to be correlated with listener performance, when it really isn't.

Also, a parametric model does not have the ability to change fundamental behaviour even if new knowledge is unveiled that change the nature of the data.

SUMMARY

The In Situ Fitting System

In order to obtain improved listening performance of users of hearing aid systems, hearing aid systems are provided facilitating determination of listening performance of its users and forming part of an in situ fitting system with at least one server configured for adjusting signal processing parameters of hearing aids of the hearing aid systems for improved listening performance of its users.

Thus, an in situ fitting system configured for adjusting hearing aid signal processing parameters of a plurality of hearing aid systems during normal use of the hearing aid systems is provided, comprising at least one server interconnected with the plurality of hearing aid systems, each of which comprises a hearing aid with a microphone for provision of an audio signal in response to sound signals received at the microphone from a sound environment, a processor that is configured to process the audio signal in accordance with a signal processing algorithm $F_n(\Theta_n)$, where $\Theta_n$ is a set of signal processing parameters of signal processing algorithm $F_n$, to generate a hearing loss compensated audio signal, an output transducer for providing an output signal to a user of the hearing aid system based on the hearing loss compensated audio signal, and a server interface configured for data communication with the at least one server, for each of the hearing aid systems, a performance detector associated with the respective one of the hearing aid systems and configured for determining listening performance of a user of the associated hearing aid system, and wherein the at least one server is configured for determining a value of one of the signal processing parameters n, $\Theta_n$ based on determined listening performance of a plurality of users of the hearing aid systems, and transmitting information on the determined value to the hearing aid, and wherein the processor of the hearing aid is configured for setting the signal processing parameter to the determined value upon receipt of the information.

Information on the signal processing parameter value may be transmitted in the form of a control signal suitable for transmission to the hearing aid in question, the control signal being decoded in the hearing aid and subsequently control the hearing aid to set the signal processing parameter to the determined value upon receipt by the hearing aid. The information may be the determined value itself that is encoded into a form suitable for transmission to the hearing aid.

The in situ fitting system performs adjustment of hearing aid signal processing parameters n, $\Theta_n$ during normal use of the respective hearing aid, i.e. while the hearing aid is worn in its intended position at the ear of a user and performing hearing loss compensation in accordance with the individual hearing loss of the respective user wearing the hearing aid. The adjustment is performed in response to listening performance of one or more users as determined by the respective one or more performance detectors configured for determining listening performance relating to how well users are able to hear and respond to sound received by hearing aids worn by the users.

The in situ fitting system may be configured for automatic adjustment of at least one signal processing parameter $\theta_i \in \Theta_n$ in the hearing aid system with the library of signal processing algorithms $F_n(\Theta_n)$, where $\Theta_n$ is the set of parameters of signal processing algorithm $F_n$, including values of the index parameter n controlling selection of one or more algorithms for execution, e.g. a noise suppression algorithm may be selected for execution in a noisy environment and may not be selected for execution in a quiet environment. Thus, n is also a signal processing parameter and may be automatically adjusted by the in situ fitting system.

The in situ fitting system comprises at least one server for provision of computing power and memory resources required for its functioning. For example, the at least one server may comprise the performance detectors of, or associated with, the plurality of hearing aid systems and may be configured for receiving data from the plurality of hearing aid systems relating to the listening performance of its users and may be configured for determining user listening performance based on the received data and determining signal processing parameters for the hearing aids of the plurality of hearing aid systems in response to the determined user listening performance in order to improve the listening performance.

The at least one server may reside in a cloud computing network and/or in a grid computing network and/or another form of computing network for provision of the required computing resources for proper functioning of the in situ fitting system.

Binaural Hearing Aid

The hearing aid system may comprise a binaural hearing aid system with two hearing aids, one for the right ear and one for the left ear of the user of the hearing aid system.

Thus, the hearing aid system may comprise a second hearing aid with a second microphone for provision of a second audio input signal in response to sound signals received at the second microphone, a second processor that is configured to process the second audio input signal in accordance with a second signal processing algorithms $F_n(\Theta_n)$ to generate a second hearing loss compensated audio signal, and a second output transducer for providing a second acoustic output signal based on the second hearing loss compensated audio signal.

The circuitry of the second hearing aid is preferably identical to the circuitry of the first hearing aid apart from the fact that the second hearing aid, typically, is adjusted to compensate a hearing loss that is different from the hearing loss compensated by the first hearing aid, since; typically, binaural hearing loss differs for the two ears.

The in situ fitting system may be configured for automatic adjustment of at least one signal processing parameter $\theta_i \in \Theta_n$ of the second processor with the library of signal processing algorithms $F_n(\Theta_n)$, where $\Theta_n$ is the set of parameters of signal processing algorithm $F_n$, including values of the index parameter n controlling selection of one or more algorithms for execution, e.g. a noise suppression algorithm may be selected for execution in a noisy environment and may not be selected for execution in a quiet environment.

In binaural hearing aid systems, it is important that the signal processing algorithms of the first and second signal processors are selected in a coordinated way. Since sound environment characteristics may differ significantly at the two ears of a user, it will often occur that independent determination of category of the sound environment at the two ears of a user differs, and this may lead to undesired different signal processing of sounds in the hearing aids. Thus, preferably the signal processing algorithms of the first and second processors are selected based on the same signals, such as sound signals received at a hand-held device of the hearing aid system, or both sound signals received at the left ear and sound signals received at the right ear, or a combination of sound signals received at the hand-held device and sound signals received at the left ear and sound signals received at the right ear, etc.

Examples of Operation of the In Situ Fitting System

For example, the user listening performance relates to the user's ability to understand speech. The performance detector associated with the hearing aid system used by the user may for example reside in a server and sound received by a hearing aid of the hearing aid system may be transmitted to the performance detector residing in the server together with speech spoken by the user, and the performance detector may be configured for speech recognition and for evaluating the speech of the user in the context of speech received from another person by the hearing aid of the user and providing a performance value that reflects how well the user's speech fits the context.

For example, frequent detection of the words "sorry", "pardon", "what", or the like, or corresponding words in another language than English, spoken by the user of the hearing aid system in the context of speech from another person that would have been easy to understand by a person with normal hearing, leads to a low listening performance value.

The performance detector may rely on a statistical model of probable responses to a given external speech token. For example, the performance detector may compute the probability of each response to a given input. The performance detector or another part of the in situ fitting system may then measure the response of the user. If the user's response is highly probable, then he/she probably understood the input. The obtained information may also be used to adapt the signal processing so that the probability is maximized.

The performance detector may comprise voice recognition for recognizing words spoken by the user of the hearing aid system for separation of the user's speech from speech by others as received by the hearing aid.

The hearing aid of the hearing aid system of the user may have a directional array of microphones targeted at the user's mouth when the hearing aid is worn in its operational position by the user for spatial separation of the user's speech from speech by others.

The hearing aid may have a microphone residing in the ear canal of the user for reception of bone conducted speech from the user when the hearing aid is worn in its operational position by the user for separation of the user's speech from speech by others.

In general, the hearing aid of the hearing aid system may have a microphone system configured for recording of the user's own voice and wherein the performance detector is configured for determining listening performance of the user of the hearing aid system based on the recorded user's own voice and recorded sound from the sound environment.

The listening performance may relate to time to user response from reception of speech and optionally, the at least one server may be configured to determine at least one gain value for improved speech audibility.

The listening performance may relate to speech understanding of the user and optionally, the at least one server may be configured to determine a signal processing parameter for improved speech understanding.

The performance detector may relate a current user response to speech to a statistical model based on previous performance of the user and other users for determination of the user's performance.

One or more hearing aid systems of the plurality of hearing aid systems may comprise a direction of arrival detector configured for determination of the direction of arrival of sound at a hearing aid of the hearing aid system comprising the direction of arrival detector and optionally, an orientation sensor configured for determination of a looking direction of the user of the hearing aid system comprising the direction of arrival detector during arrival of the sound.

The performance detector may be configured for comparison of the determined direction of arrival of the sound and the time from arrival of speech until the user changes his or her looking direction towards the determined direction of arrival of the speech for example determined with an orientation sensor in one or both hearing aids of the hearing aid system.

The performance detector may be configured for comparison of the determined direction of arrival of the sound and the resulting forward looking direction of the user.

The at least one server may be configured for determination of a signal processing parameter value of the hearing aid comprising the direction of arrival detector based on the comparison, and transmission of the signal processing parameter value to the hearing aid system with the hearing aid comprising the direction of arrival detector, and wherein the processor of the hearing aid comprising the direction of arrival detector is configured for adjusting the signal processing parameter to the received value, e.g. increasing a gain value at a frequency of the received speech, whereby the time used for responding to speech from another direction than the looking direction is decreased.

The Network

The hearing aid systems and the at least one server may transmit data to each other and receive data from each other through a wired or wireless network with their respective communication interfaces. Examples of the network may include the Internet, a local area network (LAN), a wireless LAN, a wide area network (WAN), and a personal area network (PAN), either alone or in any combination. However, the network may include, or be constituted by, another type of network.

The Hand-Held Device

At least one hearing aid system of the plurality of hearing aid systems may comprise a hand-held device communicatively coupled with the hearing aid(s) of the hearing aid system, and configured for interconnecting the hearing aid(s) with the at least one server. In this way, the hearing aid system and the at least one server may transmit data to each other and receive data from each other through the hand-held device, and the hearing aid system is provided with the further communication resources and computing capabilities of the hand-held device.

The hand-held device may be, or include, a notebook computer, a personal digital assistant (PDA), a portable multimedia player (PMP), a tablet computer (PC), a GPS receiver, a mobile phone, a smart phone, e.g. an Iphone, an Android phone, windows phone, etc., e.g. with a GPS receiver, and a calendar system, etc., or any other portable device capable of communicating with the at least one server and the hearing aid.

Hearing Aid Interface

At least one hearing aid system of the plurality of hearing aid systems may have a hearing aid with an interface for connection with a Wide-Area-Network, such as the Internet.

At least one hearing aid system of the plurality of hearing aid systems may have a hearing aid that accesses the Wide-Area-Network through a mobile telephone network, such as GSM, IS-95, UMTS, CDMA-2000, etc.

At least one hearing aid system of the plurality of hearing aid systems may have a hearing aid comprising a data interface for transmission of data and/or control signals between the hearing aid and the hand-held device and optionally other parts of the hearing aid system, e.g. including another hearing aid of the hearing aid system.

The data interface may be a wired interface, e.g. a USB interface, or a wireless interface, such as a Bluetooth interface, e.g. a Bluetooth Low Energy interface.

The hearing aid may comprise an audio interface for reception of an audio signal from the hand-held device and possibly other audio signal sources.

The audio interface may be a wired interface or a wireless interface. The data interface and the audio interface may be combined into a single interface, e.g. a USB interface, a Bluetooth interface, etc.

The hearing aid may for example have a Bluetooth Low Energy data interface for exchange of sensor and control signals between the hearing aid and the hand-held device, and a wired audio interface for exchange of audio signals between the hearing aid and the hand-held device.

Hand-Held Device Interface

The hand-held device has an interface for connection with the wired or wireless network through which the hand-held device and the at least one server may transmit data to each other and receive data from each other. As mentioned above, examples of the network may include the Internet, a local area network (LAN), a wireless LAN, a wide area network (WAN), and a personal area network (PAN), either alone or in any combination. However, the network may include, or be constituted by, another type of network.

The hand-held device may access the network through a mobile telephone network, such as GSM, IS-95, UMTS, CDMA-2000, etc.

Through the network, e.g. the Internet, the hand-held device may have access to electronic time management and communication tools used by the user for communication and for storage of time management and communication information relating to the user. The tools and the stored information typically reside on a remote at least one server accessed through the network.

The Performance Model

The at least one server may have access to a performance model based on determined listening performance of a plurality of users of the plurality of hearing aid systems, and wherein the at least one server is configured for determination of a signal processing parameter value of a hearing aid based on the determined listening performance of the user of the hearing aid system and the performance model.

The performance model may include at least one user parameter selected from the group consisting of the user audiogram, age, sex, race, and native language so that signal processing parameters determined based on the model may vary for different user parameter values.

The performance model may include a hearing loss model, e.g. one of the hearing loss models mentioned in EP 2 871 858 A1.

The performance model may include various sound environment categories so that signal processing parameters determined based on the model may vary for different sound environment categories.

The at least one server may be configured for forming the performance model based on listening performance determinations and optionally other user related data, such as the user audiogram and/or age and/or sex and/or race and/or native language, etc., and optionally sound environment categories.

The performance model may include a Bayesian statistical model, a neural network, data clustering, support vector machines, etc.

Initial Fitting and Subsequent Updating

When a hearing aid is fitted to a user for the first time, the hearing aid may be adjusted for maximum listening performance of the user based on the performance model of the in situ fitting system. Upon use of the hearing aid for some time, e.g. for one day, signal processing parameters may be adjusted by the at least one server of the in situ fitting system in response to performance determinations during use since the latest signal processing parameter adjustment and in response to possible updating of the performance model, e.g. in response to performance determinations received from a plurality of hearing aid systems.

The Performance Detector

Performance determinations are performed during normal use of the hearing aid systems. The at least one server may be configured for updating the performance model based on received performance determinations. The performance determinations may be performed frequently during use, e.g. once every hour, e.g. once every 10 minutes, e.g. once every 5 minutes, e.g. once every 2 minutes, e.g. once every minute.

A hearing aid may comprise the performance detector of the hearing aid system, or a part of the performance detector of the hearing aid system, and may transmit data of determined performance to the at least one server during normal use of the hearing aid, e.g. once every hour, once every 10 minutes, once every 5 minutes, once every 2 minutes, or, once every minute.

At least one hearing aid system of the plurality of hearing aid systems may have a hand-held device that is interconnected with a hearing aid of the at least one hearing aid system and that comprises the performance detector of the hearing aid system that is configured for determination of listening performance of the user of the hearing aid system.

The performance detector, or parts of the performance detector, may reside remote from the hearing aid system, interconnected with the at least one server; or, forming part of the at least one server, thereby benefiting from the large amount of computing resources available in the at least one server and interconnecting networks. For example, the at least one server may comprise all performance detectors of the plurality of hearing aid systems.

The Location Detector

A hearing aid may comprise a location detector configured for determining a geographical position of the hearing aid and the at least one server may be configured for recording of the geographical position of the hearing aid and the hearing aid system comprising the hearing aid, and incorporation of the geographical position in the performance model.

At least one hearing aid system of the plurality of hearing aid systems may have a hand-held device that is interconnected with a hearing aid of the at least one hearing aid system and that comprises a location detector configured for determining a geographical position of the hearing aid system and the at least one server may be configured for recording of the geographical position of the hearing aid system, and incorporation of the geographical position in the performance model.

The location detector residing in the hand-held device benefits from the larger computing resources and power supply typically available in the hand-held device as compared with the limited computing resources and power available in the hearing aid.

The location detector may include at least one of a GPS receiver, a calendar system, a WIFI network interface, a mobile phone network interface, for determining the geographical position of the hearing aid system and optionally the velocity of the hearing aid system.

Signal strength of signals received by the GPS receiver decreases significantly when the hearing aid system is inside a building and thus, information on GPS signal strength may be used by the location detector to determine whether the hearing aid system is inside a building.

Information on moving speed as for example determined by the GPS receiver may be used by the location detector to determine that the hearing aid system is inside a transportation vehicle, such as in a car.

In absence of useful GPS signals, the location detector may determine the geographical position of the hearing aid system based on the postal address of a WIFI network the hearing aid system may be connected to, or by triangulation based on signals possibly received from various GSM-transmitters as is well-known in the art of mobile phones. Further, the location detector may be configured for accessing a calendar system of the user to obtain information on the expected whereabouts of the user, e.g. meeting room, office, canteen, restaurant, home, etc. and to include this information in the determination of the geographical position. Thus, Information from the calendar system of the user may substitute or supplement information on the geographical position determined by otherwise, e.g. by a GPS receiver.

Also, when the user is inside a building, e.g. a high rise building, GPS signals may be absent or so weak that the geographical position cannot be determined by a GPS receiver. Information from the calendar system on the whereabouts of the user may then be used to provide information on the geographical position, or information from the calendar system may supplement information on the geographical position, e.g. indication of a specific meeting room may provide information on which floor in a high rise building, the hearing aid system is located. Information on height is typically not available from a GPS receiver.

The location detector may automatically use information from the calendar system, when the geographical position cannot be determined otherwise, e.g. when the GPS-receiver is unable to provide the geographical position.

The Sound Environment Detector

At least one hearing aid system of the plurality of hearing aid systems may have a sound environment detector associated with it and configured for determination of the sound environment surrounding the respective hearing aid system based on sound signals received by the respective hearing aid system, e.g. from one hearing aid of the hearing aid system; or, from two hearing aids of the hearing aid system. For example, the sound environment detector may determine a category of the sound environment surrounding the respective hearing aid, such as speech, babble speech, restaurant clatter, music, traffic noise, etc.

A hearing aid of the hearing aid system may comprise the sound environment detector; or a part of the sound environment detector.

At least one hearing aid system of the plurality of hearing aid systems may have a hand-held device that is interconnected with a hearing aid of the at least one hearing aid system and that comprises the sound environment detector of, or associated with, the hearing aid system. The sound environment detector residing in the hand-held device benefits from the larger computing resources and power supply typically available in the hand-held device as compared with the limited computing resources and power available in the hearing aid.

The sound environment detector of a hearing aid system may be configured to transmit information on the determined sound environment, e.g. information on the determined category of the sound environment, to the at least one server.

The sound environment detector, or parts of the sound environment detector, may reside remote from the hearing aid system, interconnected with the at least one server; or, forming part of the at least one server, thereby benefiting from the large amount of computing resources available in the at least one server and interconnecting networks. For example, the at least one server may comprise all sound environment detectors of the plurality of hearing aid systems.

The at least one server may be configured for determination of a signal processing parameter values of a hearing aid of a hearing aid system based on the category of the sound environment of the hearing aid system determined by the sound environment detector, and for transmission of the signal processing parameter value to the hearing aid, and wherein the processor of the hearing aid may be configured for adjusting the signal processing parameter to the received value for improved listening performance in the determined sound environment.

The sound environment detector may be configured for determining the category of the sound environment surrounding a specific hearing aid system of the plurality of hearing aid systems based on the sound received by the hearing aid system, and optionally on the determined geographical position of the hearing aid system as determined by the location detector, and optionally on at least one parameter selected from the group consisting of: A date, a time of day, a velocity of the hearing aid system, and a signal strength of a signal received by the GPS receiver.

In the event that no information on geographical position is available to the location detector, e.g. from the GPS receiver and the calendar system, the sound environment detector may categorize the sound environment in a conventional way based on the received sound signal; or, the hearing aid may be set to operate in a mode selected by the user, e.g. previously during a fitting session, or when the situation occurs.

The sound environment at a specific geographical position, such as a city square, may change in a repetitive way during the year in a similar way from one year to another and/or during a day in a similar way from one day to another, e.g. due to repeated variations in traffic, number of people, etc., and such variations may be taken into account by allowing the sound environment detector to include the date and/or the time of day in the determining the category of sound environment.

Obtained classification results may be utilised in the hearing aid to automatically select signal processing characteristics of the hearing aid, e.g. to automatically switch to the most suitable signal processing algorithm and parameters for the environment category in question. Such a hearing aid will be able to automatically maintain optimum sound quality and/or speech intelligibility for the individual hearing aid user in various categories of sound environments.

For a hearing aid system with a binaural hearing aid, the sound environment detector may be configured for determining the category of the sound environment surrounding the user of the hearing aid system based on the sound signals received at both hearing aids and optionally the geographical position of the hearing aid system.

The hearing aid system may be configured for transmitting signal processing parameters together with GPS-data to the at least one server for inclusion in the performance model, e.g., for sharing of hearing aid signal processing parameter values at various geographical locations with other hearing aid system users.

Thus, the hearing aid system may be configured for retrieving a hearing aid signal processing parameter value from the at least one server at the current geographical location, e.g. based on hearing profile similarities and/or age and/or race and/or ear size, etc., and the performance model.

User Interface

At least one of the hearing aid systems may have a hearing aid comprising a user interface allowing a user of the hearing aid system comprising the hearing aid, to make adjustment of at least one signal processing parameter $\theta \in \Theta$.

At least one hearing aid system of the plurality of hearing aid systems may have a hand-held device that is interconnected with a hearing aid of the at least one hearing aid system and that comprises a user interface allowing a user of the hearing aid system comprising the hearing aid, to make adjustment of at least one signal processing parameter $\theta \in \Theta$. The user interface residing in the hand-held device benefits from the larger computing resources and power supply typically available in the hand-held device as compared with the limited computing resources and power available in the hearing aid.

The user may not be satisfied with the automatic selection of parameter values performed by the at least one server and may perform an adjustment of signal processing parameters using the user interface, e.g. the user may change the current selection of signal processing algorithm to another signal processing algorithm, e.g. the user may switch from a directional signal processing algorithm to an omni-directional signal processing algorithm; or, the user may adjust a parameter value, e.g. the volume.

The in situ fitting system may be configured for incorporation of user adjustments in the determination of signal processing parameter values, e.g. the at least one server may be configured for recording the adjustment of the at least one signal processing parameter $\theta \in \Theta$ made by the user of the hearing aid system, and incorporating the adjustment in the performance model.

The at least one server of the in situ fitting system may be configured for recording an adjustment made by the user of the hearing aid system, and modifying the automatic adjustment of the at least one signal processing parameter $\theta \in \Theta_n$ in response to the recorded adjustment based on a learning algorithm, e.g. Bayesian incremental preference elicitation, so that the next time the same listening condition, e.g. the same sound environment, is detected, the modified automatic adjustment is performed.

For more information on Bayes' theorem and Bayesian inference, c.f.: "Information Theory, Inference, and Learning Algorithms" by David J. C. Mackay, Cambridge University Press, 2003.

In this way, the in situ fitting system makes it possible to effectively learn a complex relationship between desired adjustments of signal processing parameters relating to various listening conditions and corrective user adjustments that are a personal, time-varying, nonlinear, and stochastic.

The formation and/or adjustment of the performance model may include Bayesian machine learning and/or neural networks and/or data clustering, etc.

Types of Hearing Aids

The hearing aid may be of any type configured to be head worn at, and shifting position and orientation together with, the head, such as a BTE, a RIE, an ITE, an ITC, a CIC, etc., hearing aid.

GPS

Throughout the present disclosure, the term GPS receiver is used to designate a receiver of satellite signals of any satellite navigation system that provides location and time information anywhere on or near the Earth, such as the satellite navigation system maintained by the United States government and freely accessible to anyone with a GPS receiver and typically designated "the GPS-system", the Russian GLObal NAvigation Satellite System (GLONASS), the European Union Galileo navigation system, the Chinese Compass navigation system, the Indian Regional Navigational 20 Satellite System, etc., and also including augmented GPS, such as StarFire, Omnistar, the Indian GPS Aided Geo Augmented Navigation (GAGAN), the European Geostationary Navigation Overlay Service (EGNOS), the Japanese Multifunctional Satellite Augmentation System (MSAS), etc. In augmented GPS, a network of ground-based reference stations measure small variations in the GPS satellites' signals, correction messages are sent to the GPS system satellites that broadcast the correction messages back to Earth, where augmented GPS-enabled receivers use the corrections while computing their positions to improve accuracy. The International Civil Aviation Organization (ICAO) calls this type of system a satellite-based augmentation system (SBAS).

Orientation Sensors

The hearing aid may further comprise one or more orientation sensors, such as gyroscopes, e.g. MEMS gyros, tilt sensors, roll ball switches, etc., configured for outputting signals for determination of orientation of the head of a user wearing the hearing aid, e.g. one or more of head yaw, head pitch, head roll, or combinations hereof, e.g. inclination or tilt.

Calendar Systems

Throughout the present disclosure, a calendar system is a system that provides users with an electronic version of a calendar with data that can be accessed through a network, such as the Internet. Well-known calendar systems include, e.g., Mozilla Sunbird, Windows Live Calendar, Google Calendar, Microsoft Outlook with Exchange Server, etc.

Tilt

Throughout the present disclosure, the word "tilt" denotes the angular deviation from the heads normal vertical position, when the user is standing up or sitting down. Thus, in a resting position of the head of a person standing up or sitting down, the tilt is 0°, and in a resting position of the head of a person lying down on the person's back, the tilt is 90°.

Signal Processing Library and Parameters

The signal processing algorithms may comprise a plurality of sub-algorithms or sub-routines that each performs a particular subtask in the signal processing algorithm. As an example, the signal processing algorithm may comprise different signal processing sub-routines such as frequency selective filtering, single or multi-channel compression, adaptive feedback cancellation, speech detection and noise reduction, etc.

Furthermore, several distinct selections of signal processing algorithms, sub-algorithms or sub-routines may be grouped together to form two, three, four, five or more different pre-set listening programs which the user may be able to select between in accordance with his/hers preferences.

The signal processing algorithms will have one or several related algorithm parameters. These algorithm parameters can usually be divided into a number of smaller parameters sets, where each such algorithm parameter set is related to a particular part of the signal processing algorithms or to particular sub-routines. These parameter sets control certain characteristics of their respective algorithms or subroutines such as corner-frequencies and slopes of filters, compression thresholds and ratios of compressor algorithms, filter coefficients, including adaptive filter coefficients, adaptation rates and probe signal characteristics of adaptive feedback cancellation algorithms, etc.

Values of the algorithm parameters are preferably intermediately stored in a volatile data memory area of the processing means such as a data RAM area during execution of the respective signal processing algorithms or sub-routines. Initial values of the algorithm parameters are stored in a non-volatile memory area such as an EEPROM/Flash memory area or battery backed-up RAM memory area to allow these algorithm parameters to be retained during power supply interruptions, usually caused by the user's removal or replacement of the hearing aid's battery or manipulation of an ON/OFF switch.

Signal Processing Implementations

Signal processing in the new hearing aid system may be performed by dedicated hardware or may be performed in a signal processor, or performed in a combination of dedicated hardware and one or more signal processors.

As used herein, the terms "processor", "signal processor", "controller", "system", etc., are intended to refer to CPU-related entities, either hardware, a combination of hardware and software, software, or software in execution.

For example, a "processor", "signal processor", "controller", "system", etc., may be, but is not limited to being, a process running on a processor, a processor, an object, an executable file, a thread of execution, and/or a program.

By way of illustration, the terms "processor", "signal processor", "controller", "system", etc., designate both an application running on a processor and a hardware processor. One or more "processors", "signal processors", "controllers", "systems" and the like, or any combination hereof, may reside within a process and/or thread of execution, and one or more "processors", "signal processors", "controllers", "systems", etc., or any combination hereof, may be localized on one hardware processor, possibly in combination with other hardware circuitry, and/or distributed between two or more hardware processors, possibly in combination with other hardware circuitry.

Also, a processor (or similar terms) may be any component or any combination of components that is capable of performing signal processing. For examples, the signal processor may be an ASIC processor, a FPGA processor, a general purpose processor, a microprocessor, a circuit component, or an integrated circuit.

An in situ fitting system configured for adjusting hearing aid signal processing parameters of a plurality of hearing aid systems during normal use of the hearing aid systems, includes: at least one server interconnected with the plurality of hearing aid systems, each of the hearing aid systems comprising a hearing aid with a microphone for provision of an audio signal in response to sound signals received at the microphone from a sound environment, a processor that is configured to process the audio signal in accordance with a signal processing algorithm $F_n(\Theta_n)$, where $\Theta_n$ is a set of signal processing parameters of the signal processing algorithm $F_n$, to generate a hearing loss compensated audio signal, an output transducer for providing an output signal to a user of the each of the hearing aid systems based on the hearing loss compensated audio signal, and a server interface configured for data communication with the at least one server; and a performance detector for each of the hearing aid systems, the performance detector configured for determining listening performance of the user of the associated hearing aid system; wherein the at least one server is configured for determining a value of one of the signal processing parameters of the hearing aid of one of the hearing aid systems based on determined listening performance of a plurality of the users of the hearing aid systems, and transmitting information on the determined value to the hearing aid of the one of the hearing aid systems; wherein the processor of the hearing aid of the one of the hearing aid systems is configured for setting the one of the signal processing parameters to the determined value upon receipt of the information.

Optionally, at least one of the hearing aid systems comprises a hand-held device communicatively coupled with the hearing aid of the at least one of the hearing aid systems, and configured for interconnecting the hearing aid of the at least one of the hearing aid systems with the at least one server.

Optionally, the at least one server has access to a performance model, and wherein the at least one server is configured for determining the value of the one of the signal processing parameters based on the determined listening performance and the performance model.

Optionally, the performance model includes at least one user parameter selected from the group consisting of an audiogram, age, sex, height, and native language.

Optionally, the at least one server is configured for determining the value using Bayesian machine learning, neural networks, or data clustering.

Optionally, at least one of the hearing aid systems is configured for recording a voice of the user of the at least one of the hearing aid systems, and wherein the performance detector associated with the at least one of the hearing aid systems is configured for determining listening performance of the user of the at least one of the hearing aid systems based on the recorded voice and recorded sound from the sound environment.

Optionally, the listening performance relates to a time of response by the user of the at least one of the hearing aid systems measured since a reception of speech, and wherein the at least one server is configured to determine at least one gain value of the at least one of the hearing aid systems for improved speech audibility.

Optionally, the listening performance of the user of the at least one of the hearing aid systems relates to speech understanding of the user of the at least one of the hearing aid systems.

Optionally, one of the hearing aid systems comprises: a direction of arrival detector configured for determining a direction of arrival of sound at the one of the hearing aid system; and an orientation sensor configured for determining a looking direction of the user of the one of the hearing aid systems during the arrival of the sound; wherein the performance detector is configured for comparison of the determined direction of the arrival of the sound, and the looking direction of the user of the one of the hearing aid systems; wherein the at least one server is configured for determining the value of the one of the signal processing parameters based on the comparison, and transmitting information on the determined value to the hearing aid of the one of the hearing aid systems; and wherein the processor of the hearing aid of the one of the hearing aid systems is configured for setting the one of the signal processing parameters to the determined value upon receipt of the information, whereby a deviation of the looking direction with relation to the direction of arrival is decreased.

Optionally, the in situ fitting system further includes: a sound environment detector for each of the hearing aid systems, the sound environment detector configured for determining a category of a sound environment surrounding the associated hearing aid system based on a sound signal received by the associated hearing aid system; wherein the at least one server is configured for determining the value of the one of the signal processing parameters of the hearing aid of the one of the hearing aid systems based also on the category of the sound environment determined by the associated sound environment detector.

Optionally, at least one of the hearing aid systems comprises a user interface for allowing the user of the at least one of the hearing aid systems to make adjustment of at least one of the signal processing parameters; wherein the at least one server is configured for recording the adjustment of the at least one of the signal processing parameters made by the user of the at least one of the hearing aid systems, and incorporating the adjustment in the performance model.

Optionally, at least one of the hearing aid systems comprises a location detector configured for determining a geographical position of the at least one of the hearing aid systems, and wherein the at least one server is configured for recording the geographical position of the at least one of the hearing aid systems, and incorporating the geographical position in the performance model.

Optionally, at least one of the hearing aid systems comprises at least a part of the performance detector associated with the at least one of the hearing aid systems.

Optionally, at least one of the hearing aid systems comprises at least a part of a sound environment detector.

Optionally, at least one of the hearing aid systems comprises at least a part of a location detector.

A hearing aid system is a part of the in situ fitting system.

A hearing aid includes: a microphone for provision of an audio signal in response to sound signals received at the microphone from a sound environment; a processor that is configured to process the audio signal in accordance with a signal processing algorithm $F_n(\Theta_n)$, where $\Theta_n$ is a set of signal processing parameters of the signal processing algorithm $F_n$, to generate a hearing loss compensated audio signal; an output transducer for providing an output signal to a user of the hearing aid system based on the hearing loss compensated audio signal; and a server interface configured for data communication with at least one server; wherein the processor is configured for adjusting a value of one of the signal processing parameters based on information on the value of the one of the signal processing parameters received from the at least one server, the value being based on determined listening performance of users of hearing aid systems determined by performance detectors associated with the hearing aid systems.

A hearing aid includes: a microphone for provision of an audio signal in response to sound signals received at the microphone from a sound environment; a processor that is configured to process the audio signal in accordance with a signal processing algorithm $F_n(\Theta_n)$ to generate a hearing loss compensated audio signal, where $\Theta_n$ is a set of signal processing parameters of the signal processing algorithm $F_n$; an output transducer for providing an output signal to a user of the hearing aid based on the hearing loss compensated audio signal; and a server interface configured for data communication with at least one server; wherein the processor is configured for adjusting a value of one of the signal processing parameters based on information on the one of the signal processing parameters received from the at least one server, the value being based on listening performances of users of hearing aid systems determined by performance detectors associated with the hearing aid systems.

Optionally, the value of the one of the signal processing parameters is based on the determined listening performances and a performance model.

Optionally, the performance model includes at least one user parameter selected from the group consisting of an audiogram, age, sex, height, and native language.

Optionally, the value is based on Bayesian machine learning, neural networks, or data clustering.

Optionally, at least one of the hearing aid systems is configured for recording a voice of the user of the at least one of the hearing aid systems, and wherein the performance detector associated with the at least one of the hearing aid systems is configured for determining the listening performance of the user of the at least one of the hearing aid systems based on the recorded voice and recorded environmental sound.

Optionally, the listening performance of the user of the at least one of the hearing aid systems relates to a time of response by the user of the at least one of the hearing aid systems measured since a reception of speech, and wherein the at least one server is configured to determine at least one gain value of the at least one of the hearing aid systems for improved speech audibility.

Optionally, the listening performance of the user of the at least one of the hearing aid systems relates to speech understanding of the user of the at least one of the hearing aid systems.

A hearing system includes the hearing aid, and a hand-held device communicatively coupled with the hearing aid, the hand-held device configured for interconnecting the hearing aid with the at least one server.

A hearing system includes the hearing aid, and: a direction of arrival detector configured for determining a direction of arrival of sound at the hearing system; and an orientation sensor configured for determining a looking direction of the user of the hearing aid during the arrival of the sound; wherein the value of the one of the signal processing parameters is based on a comparison between the determined direction of the arrival of the sound and the looking direction of the user of the hearing aid.

A hearing system includes the hearing aid, and a sound environment detector, the sound environment detector configured for determining a category of a sound environment surrounding the hearing system based on a sound signal received by the hearing system; wherein the value of the one of the signal processing parameters is based also on the category of the sound environment determined by the sound environment detector.

A hearing system includes the hearing aid, and a user interface for allowing the user of the hearing aid to make adjustment of at least one of the signal processing parameters.

A hearing system includes the hearing aid, and a location detector configured for determining a geographical position of the hearing system.

Optionally, the hearing aid further includes at least a part of one of the performance detectors.

Optionally, the hearing aid further includes at least a part of a sound environment detector.

Optionally, the hearing aid further includes at least a part of a location detector.

Optionally, the hearing aid is a part of an in situ fitting system.

An in situ fitting system includes the hearing aid, and the at least one server.

Optionally, the hearing aid is a part of one of the hearing aid systems.

Other features, advantageous, and/or embodiments will be described in the detailed description.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting of its scope.

DETAILED DESCRIPTION

Figure 1:
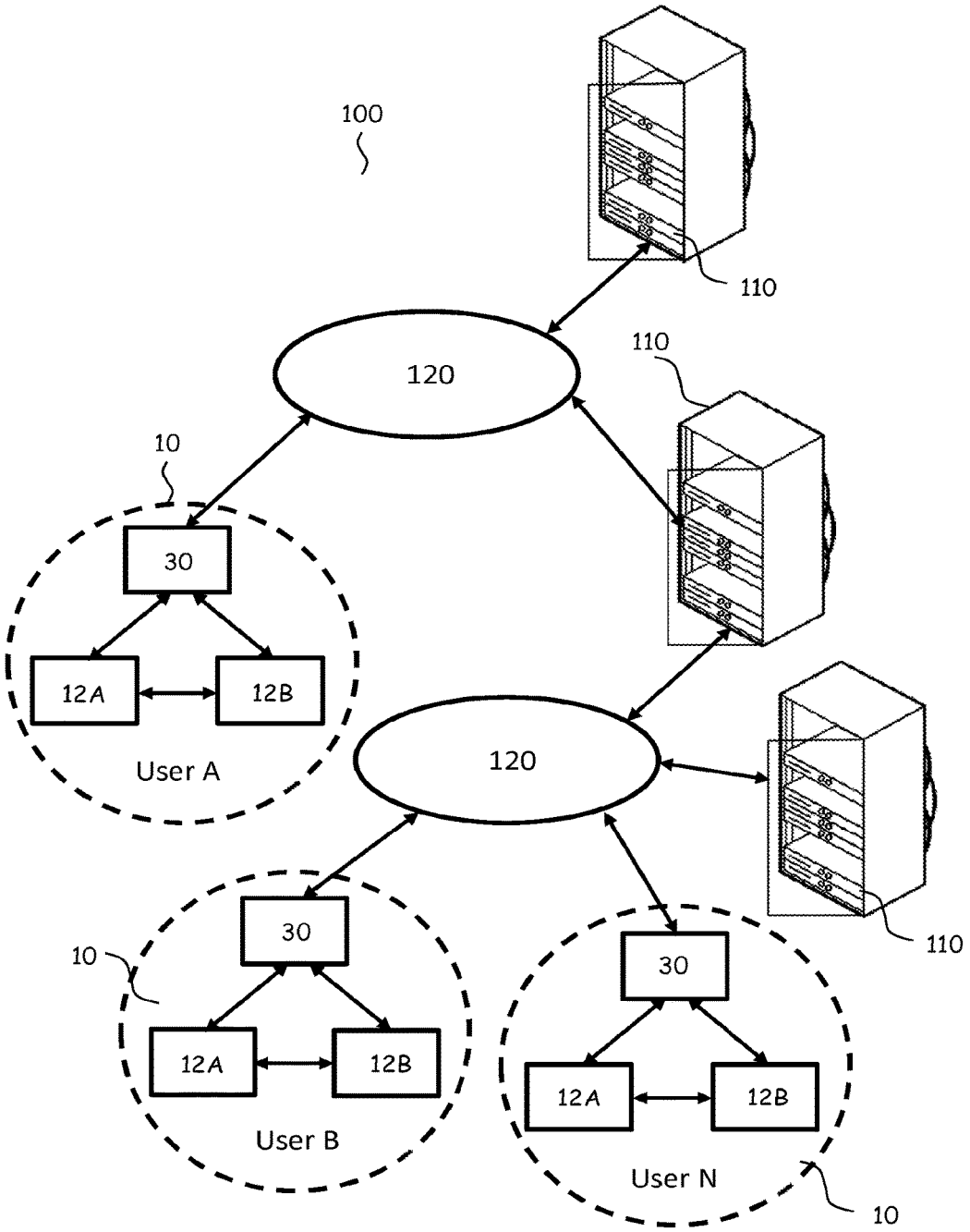
FIG. 1 shows schematically an in situ fitting system.

Various exemplary embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or not so explicitly described.

The in situ fitting system will now be described more fully hereinafter with reference to the accompanying drawings, in which various types of the in situ fitting system are shown.

The in situ fitting system may be embodied in different forms not shown in the accompanying drawings and should not be construed as limited to the embodiments and examples set forth herein.

FIG. 1

FIG. 1 schematically illustrates a in situ fitting system 100 configured for adjusting signal processing parameters of a plurality of hearing aid systems during normal use of the hearing aid systems, i.e. while the hearing aid systems are worn by their respective users providing hearing loss compensated sound signals to the users.

The in situ fitting system 100 comprises a plurality of hearing aid systems 10, each of which is worn by a respective one of a plurality of users, User A, User B, . . . , User N, and each of which comprises a binaural hearing aid system 10 with a first hearing aid 12A performing hearing loss compensation of one ear of the user and a second hearing aid 12B performing hearing loss compensation of the other ear of the user. Some of the hearing aid systems 10 forming part of the in situ fitting system 100 may have a single monaural hearing aid 12 (not shown).

Each of the hearing aid systems 10 also comprises a hand-held device 30 that provides the hearing aid system 10 with a network interface for interconnection of the hearing aids 12A, 12B of the hearing aid system 10 with one or more servers 110 through one or more networks 120.

The servers 110 are interconnected through the one or more networks 120 as is well-known in the art of computer networks, such as in the art of cloud computing, grid computing, etc.

The servers 110 are interconnected and configured for determination of signal processing parameter values of hearing aids 12A, 12B interconnected with the servers 110 through the one or more networks 120 for improved listening performance of the users of the hearing aid systems 10 comprising the hearing aids.

A determination of a signal processing parameter value of a hearing aid 12A, 12B of a hearing aid system 10 of a user is based on determined listening performance of the user. A performance detector (not shown) of the hearing aid system 10 is configured for determining the listening performance of the user. The performance detector may reside in one of the hearing aids 12A, 12B of the hearing aid system 10, or in the hand-held device 30, or in one of the servers 110, or parts of the performance detector may reside in one or more of the hearing aids 12A, 12B of the hearing aid system 10 and the hand-held device 30 and the one or more severs 110. The performance detector transmits information on the determined listening performance of the user to the one or more servers 110 and the one or more servers determine one or more processing parameter values of one or two hearing aids 12A, 12B of one or more hearing aid systems 10 based on the transmitted information. The one or more servers 110 transmit the determined one or more signal processing parameter values to the respective hearing aids through the one or more networks 110 in order to obtain improved listening performance of the users of the hearing aids receiving the determined signal processing parameter values and adjusting the signal processing parameter to the received value.

In the illustrated in situ fitting system 100, at least one of the servers 110 has access to a statistical performance model (not shown) based on determined listening performance of a plurality of users of the plurality of hearing aid systems, and the at least one server 110 is configured for determination of a signal processing parameter value of a hearing aid 12A, 12B based on the determined listening performance of the user of the hearing aid system 10 and the performance model.

The performance model may include at least one user parameter selected from the group consisting of the user audiogram, age, sex, race, height, and native language.

The performance model may include a hearing loss model, e.g. one of the hearing loss models mentioned in EP 2 871 858 A1.

The performance model may include various sound environment categories so that signal processing parameters determined based on the model may vary for different sound environment categories.

The illustrated in situ fitting system 100 has a sound environment detector configured for determination of the sound environment surrounding the individual hearing aid systems 10 based on sound signals received by the respective individual hearing aid systems 10, e.g. from one hearing aid 12A, 12B of the respective hearing aid system 10; or, from two hearing aids 12A, 12B of the respective hearing aid system 10. For example, the sound environment detector may determine a category of the sound environment surrounding the respective hearing aid, such as speech, babble speech, restaurant clatter, music, traffic noise, etc.

A hearing aid 12A, 12B of the hearing aid system 10 may comprise the part of the sound environment detector that is configured for determination of the sound environment surrounding the hearing aid 12A, 12B in question.

At least one hearing aid system 10 of the plurality of hearing aid systems may have a hand-held device 30 that is interconnected with a hearing aid 12A, 12B of the at least one hearing aid system 10 and that comprises the part of the sound environment detector that is configured for determination of the sound environment surrounding the hearing aid 12A, 12B in question. The part of the sound environment detector residing in the hand-held device 30 benefits from the larger computing resources and power supply typically available in the hand-held device 30 as compared with the limited computing resources and power available in the hearing aid 12A, 12B.

A part of the sound environment detector residing in a hearing aid system 10 may be configured to transmit information on the determined sound environment, e.g. information on the determined category of the sound environment, to the at least one server 110.

The sound environment detector, or parts of the sound environment detector, may reside remote from the hearing aid systems 10, interconnected with the at least one server 110; or, forming part of the at least one server 110, thereby benefiting from the large amount of computing resources available in the at least one server 110 and interconnecting networks 120. For example, the at least one server 110 may comprise all parts of the sound environment detector of the in situ fitting system 100.

The at least one server 110 may be configured for determination of a signal processing parameter value of a hearing aid 12A, 12B of a hearing aid system 10 based on the category of the sound environment of the hearing aid system 10 determined by the sound environment detector, and for transmission of the signal processing parameter value to the hearing aid 12A, 12B, and the processor of the hearing aid 12A, 12B may be configured for adjusting the signal processing parameter to the received value for improved listening performance of the user of the hearing aid system 10 in the determined sound environment.

The at least one server may be configured for forming the performance model based on listening performance determinations and optionally other user related data, such as the user audiogram and/or age and/or sex and/or race and/or height and/or native language, etc., and optionally sound environment categories.

FIG. 2

Figure 2:
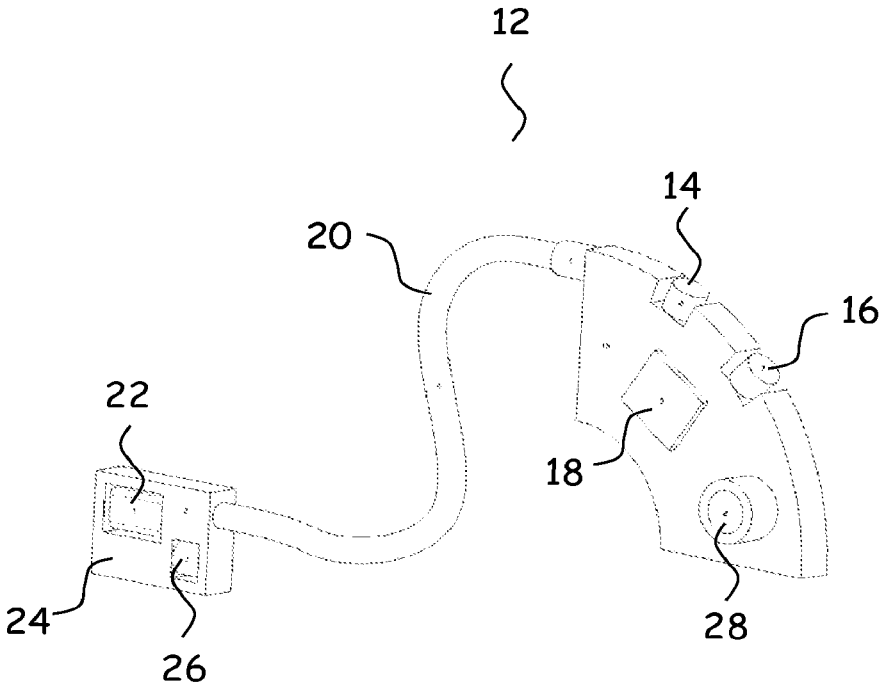
FIG. 2 schematically illustrates a hearing aid of a hearing aid system of the in situ fitting system, FIG. 3 schematically illustrates a fitting system for initial fitting of a hearing aid of a hearing aid system of the in situ fitting system.

FIG. 2 schematically illustrates a BTE hearing aid 12 comprising a BTE hearing aid housing (not shown—outer walls have been removed to make internal parts visible) to be worn behind the pinna 200 of a user. The BTE housing (not shown) accommodates a front microphone 14 and a rear microphone 16 for conversion of a sound signal into a microphone audio sound signal, optional pre-filters (not shown) for filtering the respective microphone audio sound signals, A/D converters (not shown) for conversion of the respective microphone audio sound signals into respective digital microphone audio sound signals that are input to a signal processor 18 configured to generate a hearing loss compensated output signal based on the input digital audio sound signals.

The hearing loss compensated output signal is transmitted through electrical wires contained in a sound signal transmission member 20 to a receiver 22 for conversion of the hearing loss compensated output signal to an acoustic output signal for transmission towards the eardrum of a user and contained in an earpiece 24 that is shaped (not shown) to be comfortably positioned in the ear canal of a user for fastening and retaining the sound signal transmission member in its intended position in the ear canal of the user as is well-known in the art of BTE hearing aids.

The earpiece 24 also holds one microphone 26 that is positioned for abutment of a wall of the ear canal when the earpiece is positioned in its intended position in the ear canal of the user for reception of the user's own voice utilizing bone conduction of the voice to the microphone 26. The microphone 26 is connected to an A/D converter (not shown) and optional to a pre-filter (not shown) in the BTE housing 12, with interconnecting electrical wires (not visible) contained in the sound transmission member 20.

The BTE hearing aid 12 is powered by battery 28.

The signal processor 18 is configured for execution of a number of different signal processing algorithms of a library of signal processing algorithms $F_n(\Theta_n)$ stored in a non-volatile memory (not shown) connected to the signal processor 18. Each signal processing algorithm $F_n(\Theta_n)$, or a combination of them, is tailored to particular user preferences and particular categories of sound environment. $\Theta_n$ is the set of parameters of signal processing algorithm $F_n$.

Initial settings of signal processing parameters of the various signal processing algorithms are typically determined during an initial fitting session in a dispenser's office and programmed into the hearing aid by activating desired algorithms and setting algorithm parameters in a non-volatile memory area of the hearing aid and/or transmitting desired algorithms and algorithm parameter settings to the non-volatile memory area. Subsequently, the in situ fitting system shown in FIG. 1 is configured for automatic adjustment of at least one signal processing parameter $\theta_i \in \Theta_n$ in the hearing aid 12 with the library of signal processing algorithms $F_n(\Theta_n)$.

Various functions of the signal processor 18 are disclosed above and in more detail below.

FIG. 3

Figure 3:
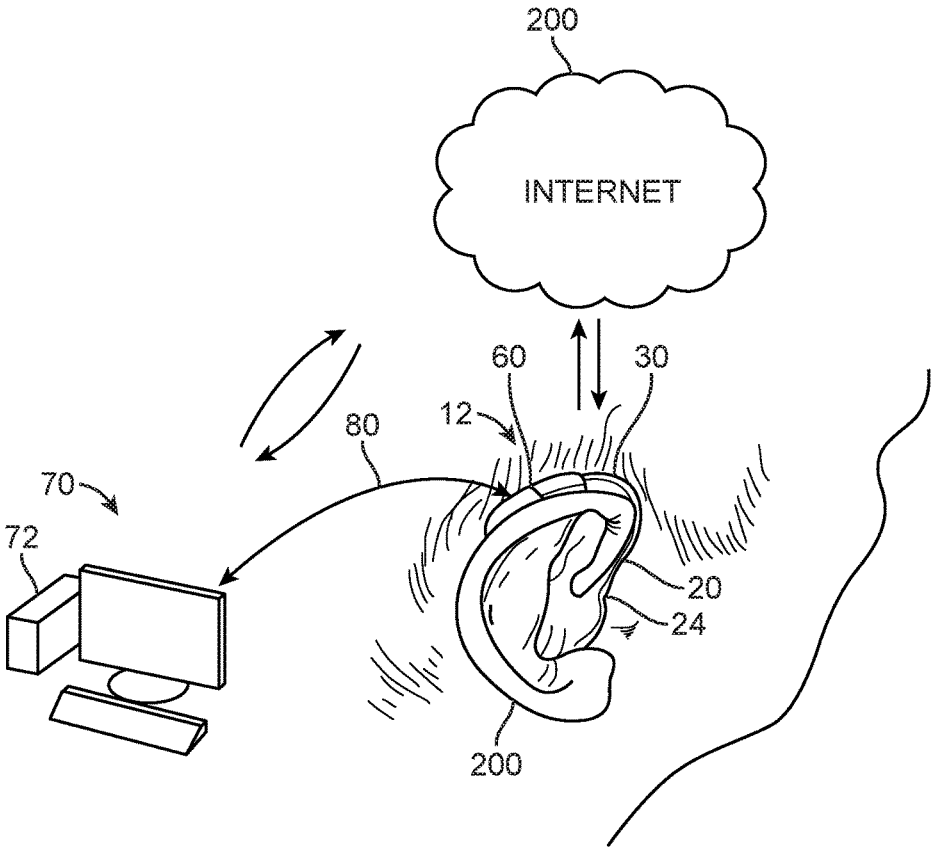

FIG. 3 shows the hearing aid 12 in its operating position with the BTE housing 60 behind the ear, i.e. behind the pinna 200, of the user. As illustrated, the hearing aid 12 may have an arm 64 that is flexible and intended to be positioned inside the pinna 200, e.g. around the circumference of the conchae behind the tragus and antitragus and abutting the antihelix and at least partly covered by the antihelix for retaining the earpiece 24 in its intended position inside the outer ear of the user. The arm may be pre-formed during manufacture, preferably into an arched shape with a curvature slightly larger than the curvature of the antihelix, for easy fitting of the arm into its intended position in the pinna 200. The earpiece 25 may also accommodate a microphone positioned at the entrance to the ear canal for reception of incoming sound and for provision of a corresponding output signal that may be combined with output signals from one or more microphones accommodated in the BTE housing 60.

FIG. 3 also schematically illustrates a fitting instrument 70 and its wireless interconnections with a network 120, such as the Internet and forming part of the in situ fitting system 100.

Data relating to a hardware and/or software configuration of the hearing aid 12 may be transmitted wirelessly 80 to the fitting instrument 70, e.g. to be displayed on a display of the fitting instrument 70 for verification by the operator of the fitting instrument 70, and possible corrective action in the event that the configuration of the hearing aid differs from the intentions.

The fitting instrument 70 is configured for performing initial fitting of the hearing aid 12 in accordance with information received from the one or more servers of the in situ fitting system 100, e.g. with new values of fitting parameters based on recent updates of the performance model. whereby the fitting instrument 70 selects parameters that maximize the predicted listening performance of the user given the received information, such as audiogram, age, performance of similar users, etc.

FIG. 4

Figure 4:
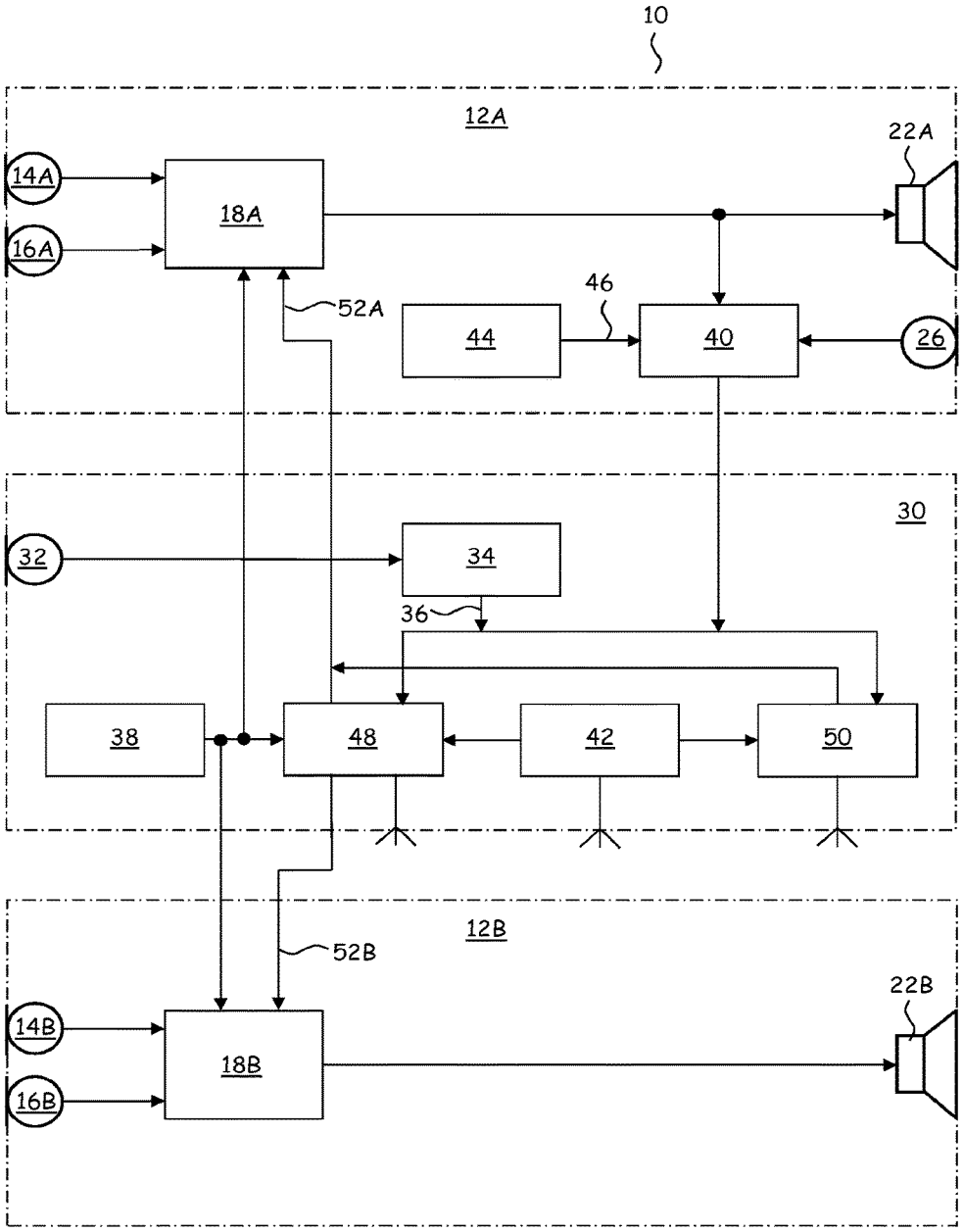
FIG. 4 shows a hearing aid system with a single hearing aid with an orientation sensor and a hand-held device with a GPS receiver, a sound environment detector, and a user interface.

FIG. 4 schematically illustrates components and circuitry of a hearing aid system 10 forming part of the in situ fitting system 100 shown in FIG. 1 and having a first hearing aid 12A, e.g. for the left ear, with an orientation sensor 44, a second hearing aid 12B, e.g. for the right ear, and a hand-held device 30 with a GPS receiver 42, a sound environment detector 34 and a user interface 38.

The hearing aids 12A, 12B may be any type of hearing aid, such as a BTE, a RIE, an ITE, an ITC, a CIC, etc., hearing aid.

Each of the illustrated hearing aids 12A, 12B comprises a front microphone 14 and a rear microphone 16 connected to respective A/D converters (not shown) for provision of respective digital input signals in response to sound signals received at the microphones 14, 16 in a sound environment surrounding the user of the hearing aid system 10. The digital input signals are input to a hearing loss processor 18 that is configured to process the digital input signals in accordance with a signal processing algorithm selected from a library of signal processing algorithms $F_n(\Theta_n)$ to generate a hearing loss compensated output signal. The hearing loss compensated output signal is routed to a D/A converter (not shown) and a receiver 22 for conversion of the hearing loss compensated output signal to an acoustic output signal emitted towards an eardrum of the user.

The hearing aid system 10 further comprises a hand-held device 30, e.g. a smart phone, facilitating data transmission between the hearing aids 12A, 12B and the at least one server 110 of the in situ fitting system 100. The illustrated hearing aids 12A, 12B and the hand-held device 30 are interconnected with, e.g., a Bluetooth Low Energy interface for exchange of sensor data and control signals between the hearing aid 12 and the hand-held device 30. The illustrated hand-held device 30 is a smart phone also having a mobile telephone interface 50, such as a GSM-interface, for interconnection with a mobile telephone network and a WIFI interface 48 as is well-known in the art of smart phones. The hand-held device 30 interconnects with the network 120 and the at least one server 110 through the Internet with the WiFi interface 48 and/or the mobile telephone interface 50 as is well-known in the art of WANs.

The hearing aid 12A comprises a performance detector 40 for determination of listening performance of the user. The performance detector 40 is connected to a microphone 26 that is positioned for reception of the user's own speech, e.g. as shown in FIG. 2 in abutment with an ear canal wall for reception of bone conducted speech of the user. The performance detector 40 is also connected to one or more orientation sensors 44, such as gyroscopes, e.g. MEMS gyros, tilt sensors, roll ball switches, etc., configured for outputting signals for determination of orientation of the head of a user wearing the hearing aid, e.g. one or more of head yaw, head pitch, head roll, or combinations hereof, e.g. tilt, i.e. the angular deviation from the heads normal vertical position, when the user is standing up or sitting down. E.g. in a resting position, the tilt of the head of a person standing up or sitting down is 0°, and in a resting position, the tilt of the head of a person lying down is 90°.

The performance detector 40 is configured for detection of speech and for recognition of words spoken by the user and indicating user difficulties in understanding speech from others, such as "sorry", "pardon", "what", or the like, or corresponding words in other languages than English. Frequent detection of such words spoken by the user of the hearing aid system in the context of speech from another person that would have been easy to understand by a person with normal hearing, leads to a low listening performance value. The performance detector 40 is configured for transmission of data relating to detection of such words and data on user timing in response to reception of speech to the at least one server, and the at least one server determines one or more signal processing parameters for improved listening performance of the user based on the received data and the performance model, whereby obtained listening performance of other users of hearing aid systems possibly with hearing losses similar to the hearing loss of the user in question is included in the determination of signal processing parameters of the hearing aid of the user in question.

The performance detector comprises a direction of arrival detector configured for determination of the direction of arrival of sound at the hearing aid 12.

The performance detector is configured for comparison of the determined direction of arrival of the sound and the time from arrival of speech until the user changes his or her looking direction towards the determined direction of arrival of the speech as indicated by the orientation sensors 44. The performance detector 40 is configured for transmission of data relating to determined user reaction times or absence of user reaction in response to reception of speech to the at least one server, and the at least one server determines one or more signal processing parameters for improved listening performance of the user based on the received data and the performance model, whereby obtained listening performance of other users of hearing aid systems possibly with hearing losses similar to the hearing loss of the user in question is included in the determination of signal processing parameters of the hearing aid of the user in question. The at least one server may for example increase a gain value at a frequency of the received speech so that the time used for responding to speech from another direction than the looking direction is decreased. The at least one server may also adjust complex gain values, e.g. in order to perform filtering.

The hand-held device 30 comprises a sound environment detector 34 for determining the category of the sound environment surrounding the user of the hearing aid system 10. The determining of the sound environment category is based on a sound signal picked up by a microphone 32 in the hand-held device. Based on the determination of the category, the sound environment detector 34 provides an output 36 to the at least one server for determination of a signal processing parameter value and/or a signal processing algorithm appropriate for the sound environment category in question.

Thus, the in situ fitting system automatically switches the hearing aid signal processor 18 to the most suitable one or more algorithm(s) for the sound environment in question whereby optimum sound quality and/or speech intelligibility is maintained in various sound environments. The signal processing algorithms of the processor 18 may perform various forms of noise reduction and dynamic range compression as well as a range of other signal processing tasks.

The sound environment detector 34 benefits from the computing resources and power supply typically available in the hand-held device 30 that are larger than the resources and power supply available in the hearing aid 12. The hand-held device 30 and/or all of, or at least some of, the hearing aid systems 10 may also benefit from the resources made available by the network(s) 120 and the at least one server 110.

The sound environment detector 34 categorizes the current sound environment into one of a set of environmental categories, such as speech, babble speech, restaurant clatter, music, traffic noise, etc.

The at least one server transmits a server parameter control signal 52A, 52B to each of the hearing aids 12A, 12B with information on the determined one or more signal processing parameters and/or signal processing algorithm(s) to be selected by the respective signal processor 18A, 18B from the available library of signal processing algorithms and parameters $F_n(\Theta_n)$ in response to the server parameter control signal 52A, 52B. Examples of signal processing parameters include: Amount of noise reduction, amount of gain and amount of HF gain, algorithm control parameters controlling whether corresponding signal algorithms are selected for execution or not, corner-frequencies and slopes of filters, compression thresholds and ratios of compressor algorithms, filter coefficients, including adaptive filter coefficients, adaptation rates and probe signal characteristics of adaptive feedback cancellation algorithms, etc.

The hand-held device 30 includes a location detector 42 with a GPS receiver configured for determining the geographical position of the hearing aid system 10. In absence of useful GPS signals, the position of the illustrated hearing aid system 10 may be determined as the address of the WIFI network access point or by triangulation based on signals received from various GSM-transmitters as is well-known in the art of smart phones.

The hand-held device 30 is configured for transmission of determined sound environment categories and geographical positions to the at least one server through the WiFi interface 48 and/or the mobile telephone interface 50. The at least one server is configured for recording the determined geographical positions together with the determined categories of the sound environment at the respective geographical positions. Recording may be performed at regular time intervals, and/or with a certain geographical distance between recordings, and/or triggered by certain events, e.g. a shift in category of the sound environment, a change in signal processing, such as a change in signal processing programme, a change in signal processing parameters, a user command entered with the user interface, etc., etc. The recorded data are included in the performance model.

When the hearing aid system 10 is located within an area of geographical positions with recordings of a specific category of the sound environment, the at least one server is configured for increasing the probability that the current sound environment is of the respective previously recorded category of the sound environment.

The hand-held device 30 is also configured for accessing a calendar system of the user, e.g. through the WiFi interface 48 and/or the mobile telephone interface 50, to obtain information on the whereabouts of the user, e.g. meeting room, office, canteen, restaurant, home, etc., and to include this information in the determining of the category of the sound environment. Information from the calendar system of the user may substitute or supplement information on the geographical position determined by the GPS receiver and transmitted to the at least one server.

Also, when the user is inside a building, e.g. a high rise building, GPS signals may be absent or so weak that the geographical position cannot be determined by the GPS receiver. Information from the calendar system on the whereabouts of the user may then be used to provide information on the geographical position, or information from the calendar system may supplement information on the geographical position, e.g. indication of a specific meeting room may provide information on the floor in a high rise building. Information on height is typically not available from a GPS receiver.

Information on the orientation of the head of the user is also transmitted to the at least one server to be included in the performance model and form basis for determination of signal processing parameters and/or algorithms of the hearing aid 12.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid, comprising:

a microphone for provision of an audio signal in response to sound signals received at the microphone from a sound environment;

a processor that is configured to process the audio signal in accordance with a signal processing algorithm $F_n(\Theta_n)$ to generate a hearing loss compensated audio signal, where $\Theta_n$ is a set of signal processing parameters of the signal processing algorithm $F_n$;

an output transducer for providing an output signal to a user of the hearing aid based on the hearing loss compensated audio signal; and an interface configured for data communication with at least one server;

wherein the processor is configured for adjusting a value of one of the signal processing parameters based on information on the one of the signal processing parameters received from the at least one server, the value being based on listening performances of users of hearing aid systems determined by performance detectors associated with the hearing aid systems.

2. The hearing aid according to claim 1, wherein at least one of the hearing aid systems is configured for recording a voice of the user of the at least one of the hearing aid systems.

3. The hearing aid according to claim 2, wherein the performance detector associated with the at least one of the hearing aid systems is configured for determining the listening performance of the user of the at least one of the hearing aid systems based on the recorded voice.

4. The hearing aid according to claim 2, wherein the performance detector associated with the at least one of the hearing aid systems is configured for determining the listening performance of the user of the at least one of the hearing aid systems based on environmental sound.

5. The hearing aid according to claim 2, wherein the listening performance of the user of the at least one of the hearing aid systems relates to a time of response by the user of the at least one of the hearing aid systems measured since a reception of speech.

6. The hearing aid according to claim 2, wherein the at least one server is configured to determine at least one gain value of the at least one of the hearing aid systems for improved speech audibility.

7. The hearing aid according to claim 2, wherein the listening performance of the user of the at least one of the hearing aid systems relates to speech understanding of the user of the at least one of the hearing aid systems.

8. A hearing system comprising the hearing aid of claim 1, and a hand-held device communicatively coupled with the hearing aid, the hand-held device configured for interconnecting the hearing aid with the at least one server.

9. A hearing system comprising the hearing aid of claim 1, and:

a direction of arrival detector configured for determining a direction of arrival of sound at the hearing system; and an orientation sensor configured for determining a looking direction of the user of the hearing aid during the arrival of the sound.

10. A hearing system comprising the hearing aid of claim 1, and a sound environment detector, the sound environment detector configured for determining a category of a sound environment surrounding the hearing system based on a sound signal received by the hearing system;

wherein the value of the one of the signal processing parameters is based also on the category of the sound environment determined by the sound environment detector.

11. A hearing system comprising the hearing aid of claim 1, and a user interface for allowing the user of the hearing aid to make adjustment of at least one of the signal processing parameters.

12. A hearing system comprising the hearing aid of claim 1, and a location detector configured for determining a geographical position of the hearing system.

13. The hearing aid according to claim 1, further comprising at least a part of one of the performance detectors.

14. The hearing aid according to claim 1, further comprising at least a part of a sound environment detector.

15. The hearing aid according to claim 1, further comprising at least a part of a location detector.

16. The hearing aid according to claim 1, wherein the hearing aid is a part of an in situ fitting system.

17. An in situ fitting system comprising the hearing aid of claim 1, and the at least one server.

18. The hearing aid according to claim 1, wherein the hearing aid is a part of one of the hearing aid systems.

* * * * *